United States Patent [19]

Morgan

[11] 4,167,414

[45] Sep. 11, 1979

[54] REFLECTIVE OPAQUE POLYESTER FILM BASE SUPPORT FOR INVERSE TRANSFER NEGATIVE EMULSIONS

[75] Inventor: James G. Morgan, Cranbury, N.J.

[73] Assignee: E. I. DuPont de Nemours and Company, Wilmington, Del.

[21] Appl. No.: 946,717

[22] Filed: Sep. 28, 1978

[51] Int. Cl.[2] ..... G03C 1/78

[52] U.S. Cl. ..... 96/87 R; 96/29 R

[58] Field of Search ..... 96/87 R, 87 A, 67, 29 R

[56] References Cited

U.S. PATENT DOCUMENTS

| | | | |
|---|---|---|---|
| 3,635,855 | 1/1972 | Earhart et al. | 96/87 A |
| 3,751,280 | 8/1973 | Nerurkar et al. | 96/87 R |
| 3,860,427 | 1/1975 | Matsuo et al. | 96/87 R |
| 3,864,132 | 2/1975 | Rasch et al. | 96/87 R |
| 3,873,314 | 3/1975 | Woo et al. | 96/87 R |
| 3,874,876 | 4/1975 | Hibino et al. | 96/87 R |

*Primary Examiner*—Jack P. Brammer

[57] ABSTRACT

An opaque polyester film base, coated with several subbing layers, provides a substitute for paper supports currently used for photographic silver halide emulsion films. The film base is energy-treated and then coated sequentially with (1) a white reflective layer comprising titanium dioxide, a polyfunctional aziridine, and an acrylic binder which is crosslinked to the functional groups in the energy-treated base by the aziridine, and (2) an intermediate substratum containing gelatin for anchoring the negative silver halide emulsion.

7 Claims, 1 Drawing Figure

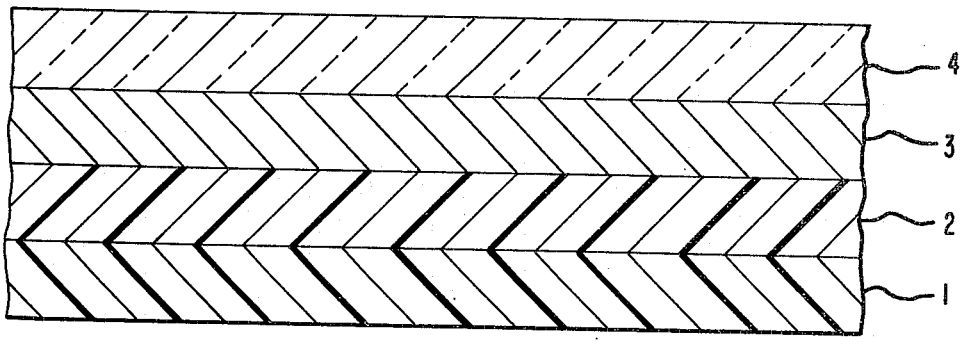
4
3
2
1

REFLECTIVE OPAQUE POLYESTER FILM BASE SUPPORT FOR INVERSE TRANSFER NEGATIVE EMULSIONS

DESCRIPTION

1. Technical Field

This invention relates to photographic film, and is more specifically concerned with photographic diffusion transfer film to be used in so-called "instant cameras" which deliver a direct print of a subject.

2. Background Art

So-called "instant cameras" employ a multi-layer film pack of which at least one layer is a silver halide emulsion layer, and another is an image-receiving layer. After exposure of the silver halide emulsion it is wetted with a liquid processing composition which develops the latent image to an insoluble silver image, and simultaneously dissolves the unexposed, silver halide which diffuses to the adjacent image-receiving layer. Here it is reduced to metallic silver to form the image. The result is a reversed or positive "print" of the developed image, which can be stripped from the negative to provide a finished direct positive photograph.

In one specific embodiment described in Earhart et al, U.S. Pat. No. 3,635,855, the film which serves as the negative employs a black polyester sheet as the film base, one surface of which is coated with, first, a white layer containing titanium dioxide pigment and a low viscosity cellulose nitrate binder, second, a conventional gelatin subbing layer, and, third, a light-sensitive gelatino-silver halide emulsion. The black support serves to keep extraneous light from coming through the support, and the white layer permits the use of shorter exposure times thus, exposure of the light-sensitive material in the emulsion coating is accomplished not only by the light that strikes the emulsion as it comes through the lens system of the camera, but also by that portion of the light that is reflected back from the white layer (between the emulsion and the opaque film base). The present invention provides an improvement over the present state of the art, particularly in the film base support to which a diffusion transfer negative emulsion of the type described above is anchored.

BRIEF DESCRIPTION OF THE DRAWING

The accompanying FIGURE forms a material part of this disclosure and is a cross-sectional view of a diffusion transfer film made in accordance with the present invention.

DISCLOSURE OF INVENTION

Referring to the drawing: a film base comprising a sheet 1 of opaque carbon black-filled polyethylene terephthalate, which has been energy treated, is coated successively with a white reflective layer 2, comprising titanium dioxide pigment, a polyfunctional aziridine, and an acrylic binder which is crosslinked to the functional groups in the energy-treated base by the aziridine; a gelatin-binder intermediate substratum 3; and a photosensitive gelatino-silver halide diffusion transfer emulsion layer 4. The invention resides in the improved anchorage contributed by the aziridine acting as a crosslinking agent between the film base and the opaque reflective layer.

Aziridines are polyfunctional crosslinking agents which are known in the art as hardeners for various polymer compositions, including acrylic polymers, but they are not disclosed for use as anchoring agents which is their function in the present invention. Their selection for this function was not an obvious innovation, for it was logical to everyone that aziridines would react entirely with the acrylic binder rather than anchoring to the polyester base. It was also logical to suppose that they would behave like more conventional crosslinking agents such as polyisocyanates. If they did, they would change the photographic properties of the emulsion coated on said base. It was surprising to find that they had neither of these disadvantages.

DETAILED DESCRIPTION OF THE INVENTION

The invention is illustrated by the following Examples, wherein ratios are in parts by weight, unless otherwise stated.

EXAMPLE 1

An aqueous dispersion was prepared having the following composition:

| | % Solids |
|---|---|
| A water-borne colloidal dispersion containing about 7.5% Cello-Solve® and about 30% of a terpolymer composed of Methyl methacrylate (66)/ethyl acrylate (29)/methacrylic acid (5) having an inherent viscosity in the range of 0.27–0.32 measured at 25° C. on a solution containing 0.5 grams of polymer in 100 ml solution | 35.28 |
| Titanium dioxide pigment (>0.5 micron) dispersed in water | 63.61 |
| Fluorochemical surfactant having the general structure $[(F(CF_2CF_2)_n—(CH_2)_2—S—(CH_2)_2—CO_2—]\ Li^+$ where n=3, 4, or 5 | 0.05 |
| Pentaerythritol-tri-[β-(N-aziridinyl)-propionate] | 1.06 |
| | 100.00 |

This dispersion was coated on flame-treated opaque polyethylene terephthalate film having an opacity of >10 and a thickness of 3.6 mils (0.009 cm) and having an antistatic backing layer. It was dried to give a white reflective layer having a dry coating weight of 220 mg/dm$^2$. This was overcoated with a solution of terpolymer I and gelatin in a ratio of 2:1, to give a layer having a dry coating weight of 3 mg/dm$^2$. The antistatic layer was prepared as described in U.S. Pat. No. 3,753,765 and comprised 2.5 parts of methyl methacrylate/ethyl acrylate/methacrylic acid copolymer binder to one part of conductive carbon.

Testing for wet and dry adhesion was performed by the following techniques. For dry anchorage, a sample of the above film was scribed in a line pattern so as to cut through the white reflective layer and to expose a plurality of edges of said layer. A piece of adhesive tape, one end of which was left unattached, was placed over the scribed area and rubbed several times with the finger to insure intimate contact. After a 15 minute wait, the tape was snapped rapidly, in one motion, off the scribed polyester support by pulling the unattached edge of the tape. The tape did not pull the white reflective layer off with it, thus demonstrating good adhesion of the white reflective layer to the support.

For wet anchorage a 3×8 inch (7.60×20.32 cm) sample of said polyester support with its white reflective coating was immersed, at room temperature, in a 0.5% aqueous dispersion of a fluorochemical surfactant having the structure:

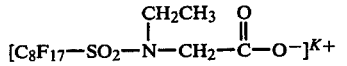

After 30 minutes the sample was removed and checked for blistering. No blistering occurred. The sample was reimmersed in said solution and an hourly check made for blistering. No blistering occurred. The sample was again immersed in said dispersion and checked after 48 hours. The sample showed no blistering.

A white reflective layer composition made as above, with the omission of the aziridine, failed the wet anchorage test. A white reflective layer composition made as above with a non-acrylic binder substituted in place of the acrylic binder failed the wet anchorage test. A white reflective layer made as above and coated on a non-flame treated polyethylene terephthalate base also failed the wet anchorage test.

EXAMPLE 2

Coating dispersions were prepared having the following compositions:

| | Wt. in Grams | | | |
|---|---|---|---|---|
| | 1 | 2 | 3 | 4 |
| Methyl methacrylate/ethyl acrylate/methacrylic acid terpolymer as in Example 1 | 4176 | → | → | → |
| Titanium dioxide pigment | 2250 | → | → | → |
| 2% soluton of fluorochemical surfactant described in Ex. 1 | 80 | → | → | → |
| Trimethylolpropane-tri-[β-(N-aziridinyl)-propionate] | 18.6 | 27.9 | 36 | — |
| Pentaerythritol-tri-[β-(N-aziridinyl)-propionate] | — | — | — | 27.9 |
| 25% solution of Polywet® ND-2, Uniroyal, Naugatuck, Conn. 06770* | 13.5 | → | → | → |
| Distilled water | 3539.5 | → | → | → |

*Prepared from one or more polymerizable functional monomers and contains a non-functional hydrocarbon end group: R—X— $(CH_2CR'Y)_z \cdot (CH_2CR^2Z)_b$—H oligomers.

These solutions were coated, dried, and tested for wet and dry anchorage as described in Example 1. Results show the sample prepared with coating solution 1 showed blistering after 16 hours in the wet anchorage test, whereas samples with coating solutions 2, 3, and 4 showed no blisters. Therefore, the lower limit for the aziridine compounds is between 2 and 3% by weight based on the binder.

While the preferred polyfunctional aziridine is pentaerythritol-tri-[β-(N-aziridinyl)-propionate],

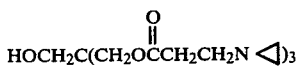

other polyfunctional aziridine hardeners which can be employed include not only trimethylolpropane-tri-[β-(N-aziridinyl)-propionate]

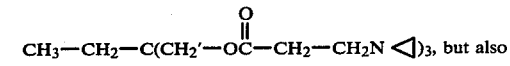

trimethylol-tri-[β-(N-[methylaziridinyl])-propionate]

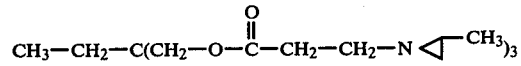

and any others that are reasonably soluble and stable in water, that contain at least two aziridine groups in order to effect crosslinking, and, in the coating composition of this invention, will effect a rapid and complete cure at the temperatures at which the coating composition is cured after it has been applied to the polyester support, e.g., about 130° C. in a time span of less than one minute.

The aziridine should be used in proportions of >2 to <7% by weight, preferably 3%, based on the dry weight of the acrylic polymer.

Referring to the drawing, the polyester support 1 may be composed of any polyester of a dicarboxylic acid and a dihydric alcohol of the type described in Alles U.S. Pat. No. 2,779,684 and the patents referred to in the specification of that patent. Other suitable supports are the polyethylene terephthalate/isophthalates of British Pat. No. 766,290 and Canadian Pat. No. 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al, U.S. Pat. No. 3,052,543, may be used. The above polyester supports are particularly suitable because of their dimensional stability. They are rendered opaque by the incorporation of carbon black, as described, e.g., in U.S. Pat. No. 3,607,818. In one embodiment a polyethylene terephthalate base was employed having a sufficient amount of carbon black of particle size 0.05 to 1.0 micron dispensed therein to give an optical density of at least 9.7.

It is believed that energy treatment of the polyester support 1 by electrical discharge, flame, or chemical treatment creates active sites on the base surface, which are believed to be carboxyl groups. It is believed that each of these in turn reacts with, and couples to, one of the aziridine groups of the polyfunctional aziridine molecule, and that other aziridine groups of the polyfunctional aziridine molecule crosslink to the acrylic binder. When a conventional aldehyde hardener such as formaldehyde is substituted for the aziridine in the formulation of this invention, poor base adhesion results because aldehyde hardeners do not react with and couple to these active sites on the energy-treated base.

The coating weights of the white reflective layer 2 of this invention can vary widely. The lower limit is about 160 mg/dm$^2$ and the upper limit is set only by the amount which can be coated economically. However, the preferred range is 215–225 mg/dm$^2$, and the ratio of titanium dioxide:acrylic polymer is 1.5–1.95:1 (preferred 1.8:1); titanium dioxide particle size (average): <1 micron (preferred <0.5 micron). Gelatin is excluded from white reflective layer 2 in order to make this layer hydrophobic. The coating can be applied to the polyethylene terephthalate support 1 by any conventional coating technique, e.g., skim, bar, curtain and extrusion coating; followed by drying and thermal curing to effect the desired adhesion.

The sub-overcoat layer 3, composed of acrylic polymer and gelatin in the ratio of 1.5–5.0:1, and preferably in the ratio of 2:1, is coated over said white reflective layer 2 from an aqueous dispersion comprising 1.5% solids. Coating weights are from 2–6 mg/dm$^2$, the preferred coating weight being 3 mg/dm$^2$.

The intermediate substratum 3 is coated over the white reflective layer 2 and in turn coated with layer 4. The latter is a conventional gelatino-silver halide emulsion system, e.g., gelatino-silver bromide, chloride, iodide, or mixtures of these. The silver halide emulsion can, of course, contain dyes, sensitizers, binders, and other additives conventional in the photographic art. Other polar coatings, aqueous or nonaqueous, can be applied in lieu of silver halide emulsions. An antistatic backing layer (not shown in the drawing) may also be employed.

The only acrylic polymers effective with aziridine are those containing carboxyl groups, e.g., polymers of methacrylic acid. As a general class the most effective acrylic polymers are methyl methacrylate (40–70%-)/ethyl acrylate (20–63%) /methyacrylic acid (1–7%) terpolymers. Other lower alkyl acrylates such as methyl and butyl acrylates may be used instead of ethyl acrylate. One of the virtues of using acrylic polymers as binders is that they can be applied from aqueous systems, whereas cellulose nitrate, for example, must be applied in an organic solvent, requiring expensive solvent recovery systems.

Energy treatment of the polyester support by means of flame treatment, chemical treatment, or electrical discharge treatment is conventional in the art, and hence requires no further description. Patents which illustrate such treatments are U.S. Pat. Nos. 2,493,937; 3,072,483; 3,607,818; 3,753,765; and Canadian 684,658.

While the invention has been described in terms of a structure to be used in a diffusion transfer process, it is not necessarily limited to this. It could also be employed in producing positive prints, e.g., prints for display purposes that need something more permanent than a paper base.

I claim:

1. A photographic film comprising an energy-treated opaque polyester film base support, one surface of which is coated, in order, with (1) a reflective layer comprising titanium dioxide, a polyfunctional aziridine, and a binder, (2) a gelatin-containing sub-overcoat layer, and (3) a photosensitive gelatino-silver halide emulsion layer, characterized in that the binder of layer (1) is an acrylic polymer which is crosslinked to the functional groups in the energy-treated base by means of said aziridine.

2. The photographic film of claim 1 wherein gelatin-containing sub-overcoat layer (2) is a mixture of an acrylic polymer and gelatin.

3. The photographic film of claims 1 or 2 wherein the acrylic polymer is a carboxyl-containing acrylic polymer.

4. The photographic film of claims 1 or 2 wherein the acrylic polymer is a terpolymer of methyl methacrylate, ethyl acrylate, and methacrylic acid.

5. The photographic film of claims 1, 2, 3, or 4 wherein the polyfunctional aziridine is a member selected from the group consisting of pentaerythritol-tri-[β-(N-aziridinyl)-propionate], trimethylolpropane-tri-[β-(N-aziridinyl)-propionate], or trimethylol-tri-[β-(N-{methylaziridinyl})-propionate].

6. A photographic film comprising a flame-treated opaque polyester film base support, one surface of which is coated, in order, with (1) a reflective layer comprising titanium dioxide, an acrylic binder crosslinked to said support with an aziridine crosslinking agent, the latter being employed in an amount of 2–7% by weight, based on the dry weight of the acrylic binder, (2) a gelatin-acrylic binder sub-overcoat layer, and (3) a photosensitive inverse transfer negative gelatino-silver halide emulsion layer.

7. The photographic film of claim 6 wherein the aziridine is cross-linked both to the acrylic binder and to the flame-treated opaque polyester film base support.

* * * * *